US009616307B1

(12) United States Patent
Chiang

(10) Patent No.: US 9,616,307 B1
(45) Date of Patent: Apr. 11, 2017

(54) ADJUSTABLE-COUNTERBALANCED HANDLE

(71) Applicant: Kai-Ping Chiang, Taichung (TW)

(72) Inventor: Kai-Ping Chiang, Taichung (TW)

( * ) Notice: Subject to any disclaimer, the term of this patent is extended or adjusted under 35 U.S.C. 154(b) by 0 days.

(21) Appl. No.: 14/919,242

(22) Filed: Oct. 21, 2015

(51) Int. Cl.
*A63B 53/16* (2006.01)
*A63B 60/24* (2015.01)
*A63B 53/14* (2015.01)

(52) U.S. Cl.
CPC ..... *A63B 60/24* (2015.10); *A63B 53/14* (2013.01)

(58) Field of Classification Search
CPC ..... A63B 60/24; A63B 53/14
See application file for complete search history.

(56) References Cited

U.S. PATENT DOCUMENTS

| | | | | |
|---|---|---|---|---|
| 5,865,687 | A | 2/1999 | Alzano | |
| 7,481,716 | B1 * | 1/2009 | Johnson | A63B 60/24 473/297 |
| 7,699,718 | B2 * | 4/2010 | Lindner | A63B 53/00 473/297 |
| 9,463,363 | B2 * | 10/2016 | Dingman | A63B 53/14 |
| 2013/0095941 | A1 * | 4/2013 | Bentley | H05K 5/0204 473/223 |

FOREIGN PATENT DOCUMENTS

| | | | | |
|---|---|---|---|---|
| CA | 2938684 | A1 * | 9/2015 | A63B 53/14 |
| FR | 2428833 | A1 * | 1/1980 | A01K 87/06 |
| JP | 2011104270 | A * | 6/2011 | |
| JP | 2011167243 | A * | 9/2011 | |
| JP | 2012045353 | A * | 3/2012 | |
| WO | WO 03066173 | A1 * | 8/2003 | A63B 60/24 |

* cited by examiner

*Primary Examiner* — Stephen Blau
(74) *Attorney, Agent, or Firm* — Muncy, Geissler, Olds & Lowe, P.C.

(57) ABSTRACT

A weight-adjustable-counterbalance apparatus includes a shell and at least one or more weighting member selectively added to the shell. The shell includes a container having an annular lateral wall and an end wall, and defines an opening at an end and a compartment. A first restrainer releasably fits on the end wall and in a manner being prevented from rotating relative to the container. A second restrainer releasably fits on the end of the container and in a manner being prevented from rotating relative to the container. A fastener releasably secures the first retainer, the container, and the second retainer together. The fastener has a first end retained on the first restrainer, a body inserting into the compartment, and a second end extending outside the opening and engaging with the second restrainer. The at least one or more weighting member is added by releasably fitting on the fastener.

19 Claims, 10 Drawing Sheets

ADJUSTABLE-COUNTERBALANCED HANDLE

BACKGROUND OF THE INVENTION

1. Field of the Invention

The present invention relates to a handle and, particularly, to a handle including a weight-adjustable-counterbalance apparatus.

2. Description of the Related Art

U.S. Pat. No. 5,865,687 shows a golf club including a shaft provided internally with a counterbalance weight assembly. The counterbalance weight assembly is located in the grip end of the shaft. The counterbalance weight assembly includes a counterbalance weight positioned on a threaded rod and being able to travel along the threaded rod. The golf club's moment of inertia is adjusted by changing the position of counterbalance weight. The counterbalance weight is prevented from leaving the threaded rod. The counterbalance weight assembly also includes a knurled knob attached to the upper end of the rod and extending from the top of the shaft. The grip end of the shaft is fastened with the knurled knob, so that rotation of either the grip end or the knob rotates the rod and thus causes the counterbalance weight to travel along the threaded rod.

However, this weighting technique is not user-friendly and requires many tries in order to help a user of the golf club to attain a desired condition of balance, whereby swings the golf club stably. Furthermore, the longitudinal size of the counterbalance weight is too long to allow for fine adjustments.

The present invention is, therefore, intended to obviate or at least alleviate the problems encountered in the prior art.

SUMMARY OF THE INVENTION

According to the present invention, a weight-adjustable-counterbalance apparatus includes a shell and at least one or more weighting member selectively added to the shell. The shell includes a container having an annular lateral wall and an end wall at a first end of the lateral wall, and defining an opening enclosed by a second end of lateral wall and a compartment enclosed by the lateral and end walls. A first restrainer releasably fits on the end wall of the container and in a manner being prevented from rotating relative to the container. The first restrainer has a pedestal at one end fitting on the end wall of the container and a flange at another end with a diametrical size larger than a diametrical size of the pedestal. A second restrainer releasably fits on the second end of the lateral wall of and in a manner being prevented from rotating relative to the container. A fastener releasably secures the first retainer, the container, and the second retainer together. The fastener has a first end retained on the flange of the first restrainer, a body inserting into a hole through the flange and a hole through the end wall as well as the compartment, and a second end extending outside the opening and engaging with the second restrainer. The at least one or more weighting member is added to the shell by releasably fitting on the fastener. The at least one or more weighting member is disposed inside and/or outside the compartment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a weight-adjustable-counterbalance apparatus which is adapted to fit in a handle and which has a counterbalance effect on the handle and the effect is changed by adjusting the amount of weighting member on the apparatus.

It is another objective of the present invention that the weight-adjustable-counterbalance apparatus make the handle streamlined.

Other objectives, advantages, and new features of the present invention will become apparent from the following detailed description of the invention when considered in conjunction with the accompanied drawings.

DETAILED DESCRIPTION OF THE INVENTION

Figure 1:
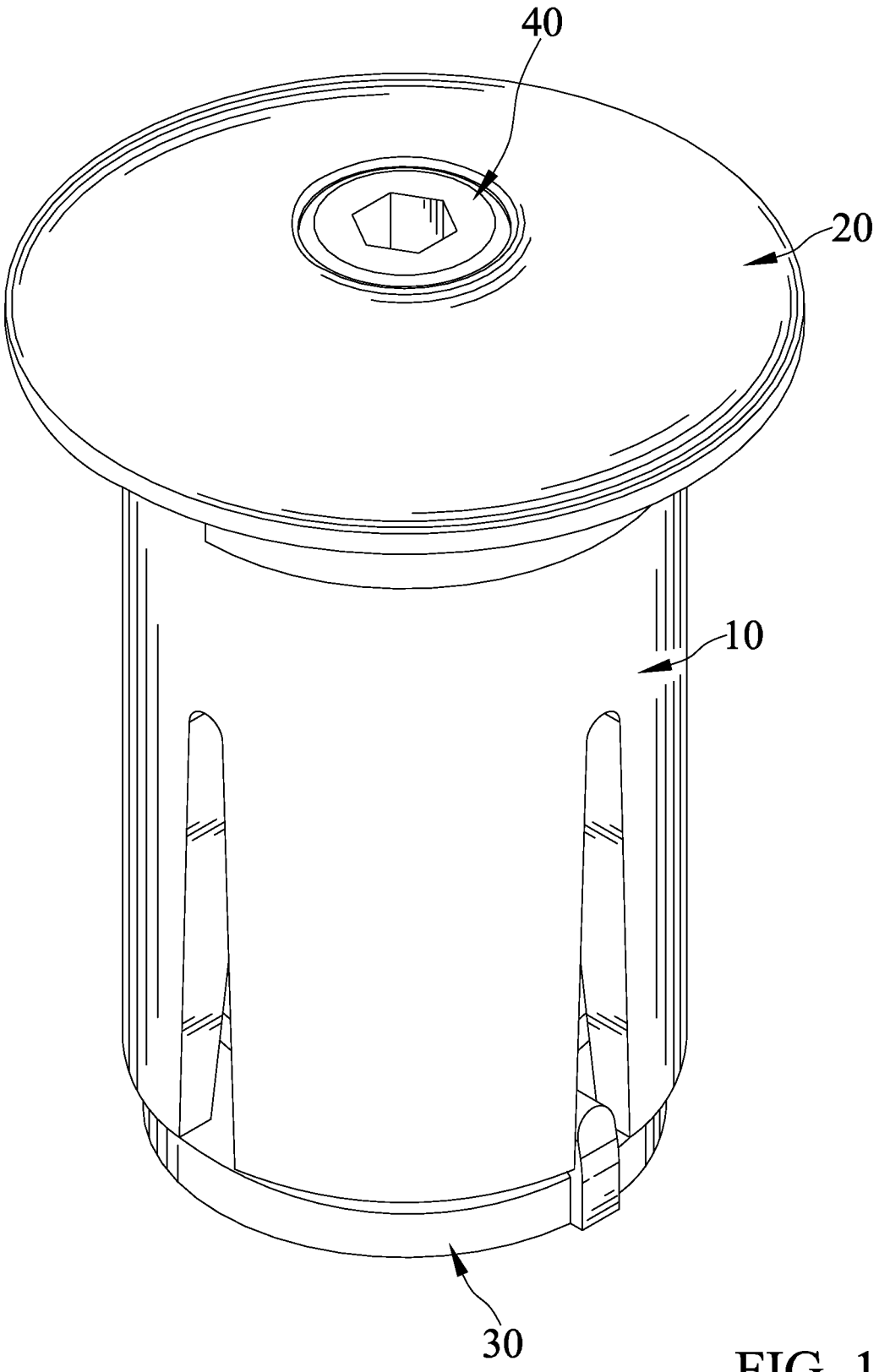
FIG. 1 is a perspective view of a weight-adjustable-counterbalance apparatus of an adjustable-counterbalanced handle in accordance with the present invention.
Figure 2:
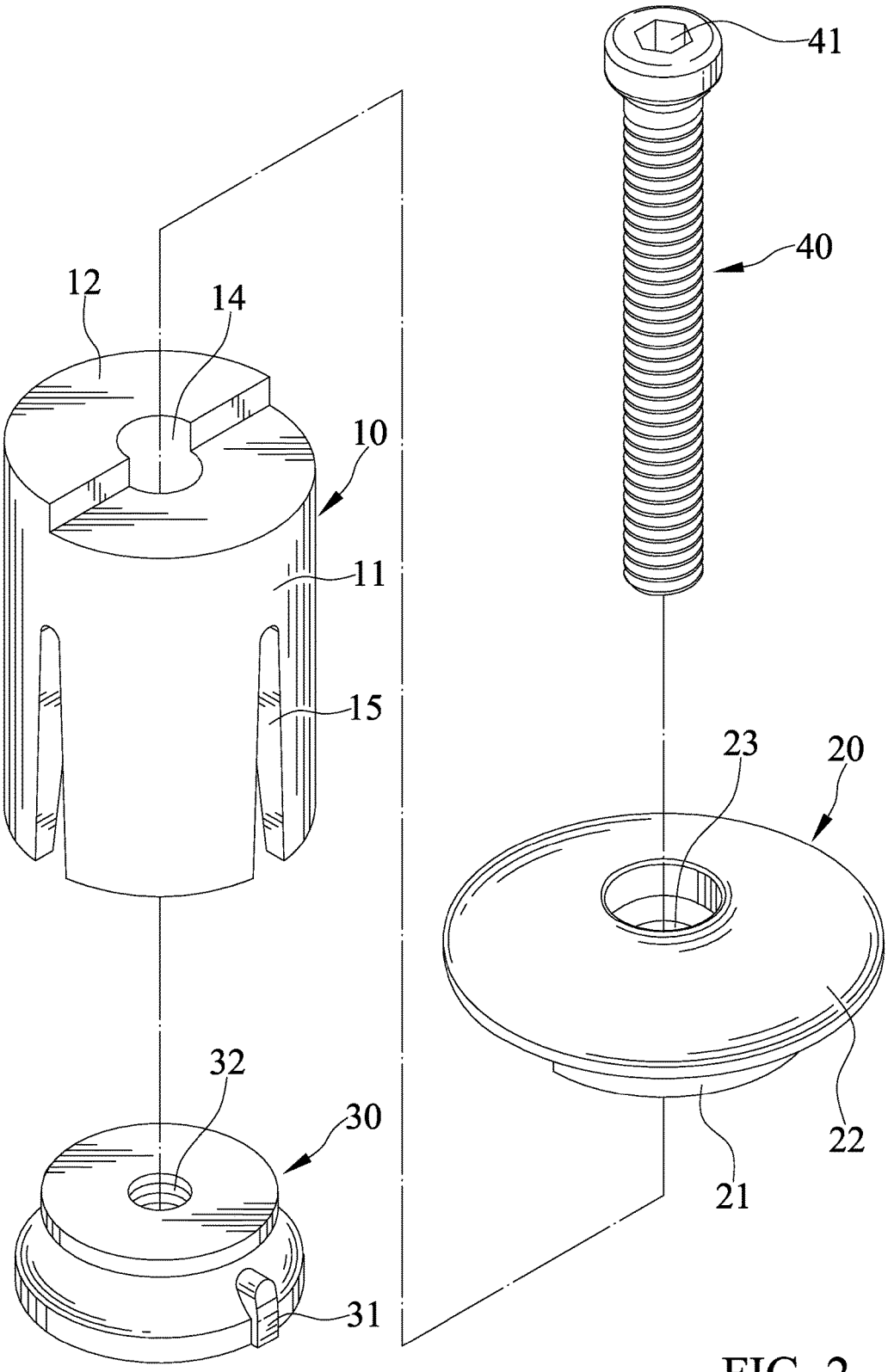
FIG. 2 is an exploded perspective view of the weight-adjustable-counterbalance apparatus of the present invention.
Figure 3:
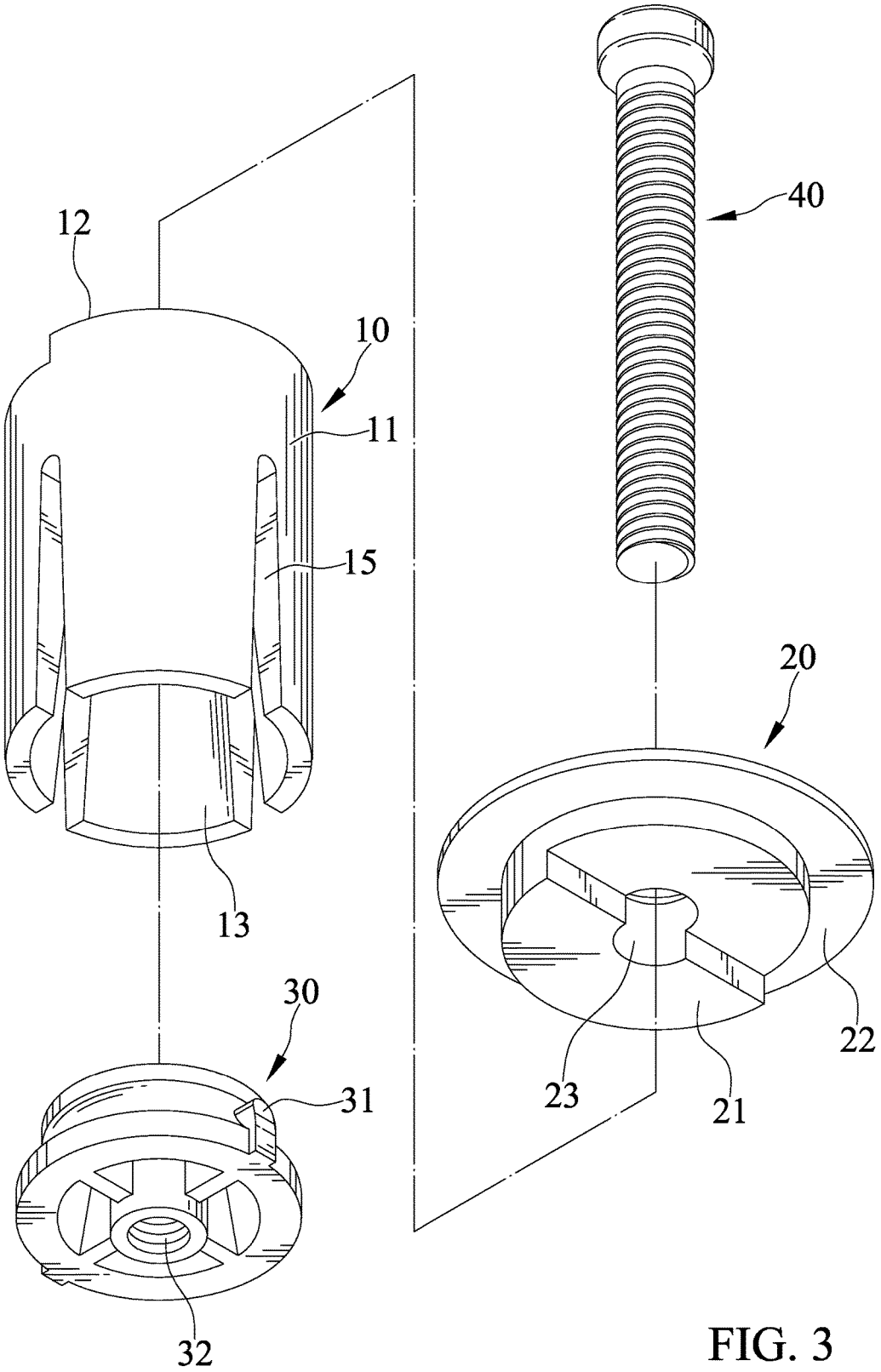
FIG. 3 is another exploded perspective view of the weight-adjustable-counterbalance apparatus at an angle of view different than that of FIG. 2.
Figure 4:
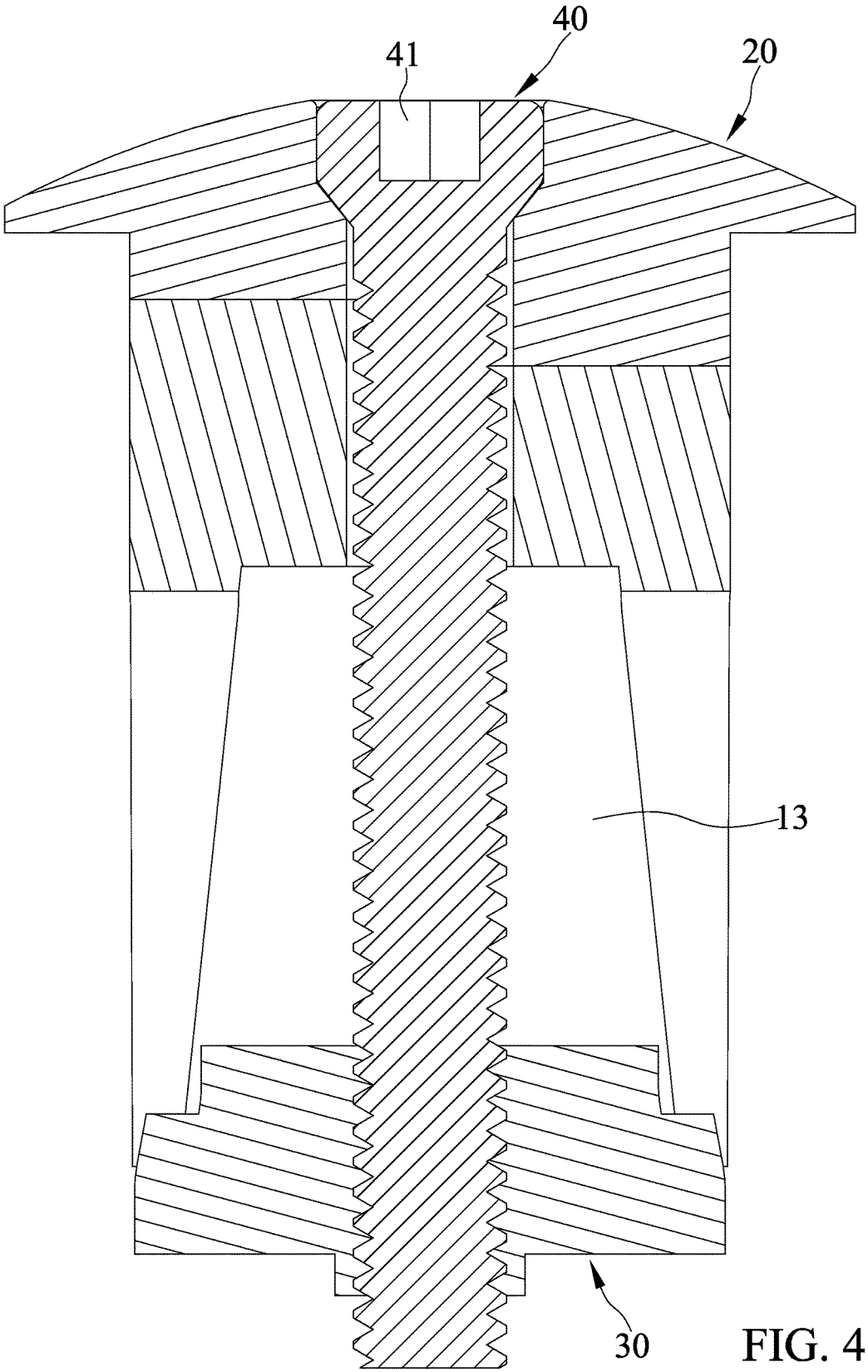
FIG. 4 is a cross-sectional view of the weight-adjustable-counterbalance apparatus of the present invention.

FIGS. 1 through 9 show a weight-adjustable-counterbalance apparatus in accordance with a first embodiment of the present invention includes a shell and at least one or weighting member 50 or more selectively added to the shell.

The shell includes a container 10, a first restrainer 20, a second restrainer 30, and a fastener 40. Each of the container 10, first restrainer 20, the second restrainer 30, and the fastener 40 is a one-piece element.

The container 10 has an annular lateral wall 11 and an end wall at a first end of the lateral wall 11. The container 10 defines an opening enclosed by a second end of lateral wall 11 and a compartment 13 enclosed by the lateral and end walls 11 and 12. The container 10 has a plurality of slots 15 on the lateral wall 11. The plurality of slots 15 extends radially through the lateral wall 11 and communicates with the compartment 13. The plurality of slots 15 has a closed end at a first end and an open end at a second end and defines a longitudinal length between the first and second end thereof. The plurality of slots 15 is disposed circumferentially on the lateral wall 11. The plurality of slots 15 allows the second end of the lateral wall 11 of the container 10 to be deformed radially if forced.

The first restrainer 20 releasably fits on the end wall of the container 10. The first restrainer 20 has a pedestal 21 at one end fitting on the end wall of the container 10 and a flange 22 at another end with a diametrical size larger than a diametrical size of the pedestal. The end wall 12 of the container 10 bears a bottom side of the pedestal 21. The flange 22 is defined on a top side of the pedestal 21, which opposes to the bottom side of the pedestal 21. The first retainer 20 is configured to be prevented from rotating about an axis relative to the container 10. The axis extends from the end wall 12 to the opening of the container 10. The end wall 12 and the pedestal 21 each have an outer edge defining a surface and a protuberance on the surface. The protuberance is at a higher height than the surface. The outer edges of the end wall 12 and the pedestal 21 have shapes matching with one another. By matching the outer edges of the end wall 12 and the pedestal 21, the container 10 and the first restrainer 20 are prevented from rotating relative to each other.

The second restrainer 30 releasably fits on the second end of the lateral wall 11 of the container 10. The second retainer 30 is configured to be prevented from rotating about the axis, which extends from the end wall 12 to the opening of the container 10, relative to the container 10. The second restrainer 30 has an outer periphery and a plurality of ribs 31 on the outer periphery. Each of the plurality of slots 15 respectively receives the each of the plurality of ribs 31. The plurality of ribs 31 is disposed circumferentially on the outer periphery of the second restrainer 30. When each of the plurality of slots 15 respectively receives each of the ribs 31, the container 10 and the second restrainer 30 are prevented from rotating relative to each other.

The fastener 40 releasably secures the first retainer 20, the container 10, and the second retainer 30 together. The fastener 40 has a first end retained on the flange 22 of the first restrainer 20, a body inserting into a hole 23 through the flange 22 and a hole 14 through the end wall 12 as well as the compartment 13, and a second end extending outside the opening and engaging with the second restrainer 30. The fastener 40 defines a threaded section and the second restrainer 30 defines a threaded hole 32 therethrough in thread engagement with the fastener 40. The fastener 40 includes the first end thereof defining a head with a cavity 41. When the second restrainer 30 is fitted with the container 10 and engaged with the fastener 40, a wrench is adapted to engage with the cavity 41 and be operably turned to disengage the fastener 40 from the second restrainer 30. The flange 22 of the first restrainer 20 defines a recess and the first end of the fastener 40 is received in the recess. The recess is of a size as such the first end of the fastener 40 is not protruded above the flange 22. The recess communicates with the hole 23 through the pedestal 21. Since the first end of the fastener 40 is not protruded above the flange 22, the contour of the flange 22 remains streamlined.

The at least one or more weighting member 50 is added to the shell by releasably fitting on the fastener 40. The at least one or more weighting member is disposed inside the compartment 13. The at least one or more weighting member 50 is insertable into the compartment 13 through the opening. If the at least one weighting member 50 is fitted on the fastener 40 and disposed inside the compartment 13. The at least one weighting member 50 is fit on the fastener 40 prior to the second restrainer 30.

The diametrical size of the pedestal 21 is not greater than a diametrical size of the lateral wall 11. The second restrainer 30 is of a diametrical size not greater than that of the lateral wall 11. The lateral wall 11 and the pedestal 21 have outer peripheries being flush, with the diametrical sizes of the lateral wall 11 and the pedestal 21 being the same. Thus, either of the outer peripheries of the pedestal 21 and the outer periphery second restrainer 30 is not greater than the outer periphery of the lateral wall 11 in diameter.

The weight-adjustable-counterbalance apparatus is used to fit in a handle. The weight-adjustable-counterbalance apparatus has a counterbalance effect on the handle engaged therewith. The effect of weight-adjustable-counterbalance apparatus is changed by adjusting the amount of weighting member 50 on the apparatus. A user of the weight-adjustable counterbalance apparatus can deform the lateral wall 11 of the container 10 radially when trying to position the shell in the handle.

Figure 5:
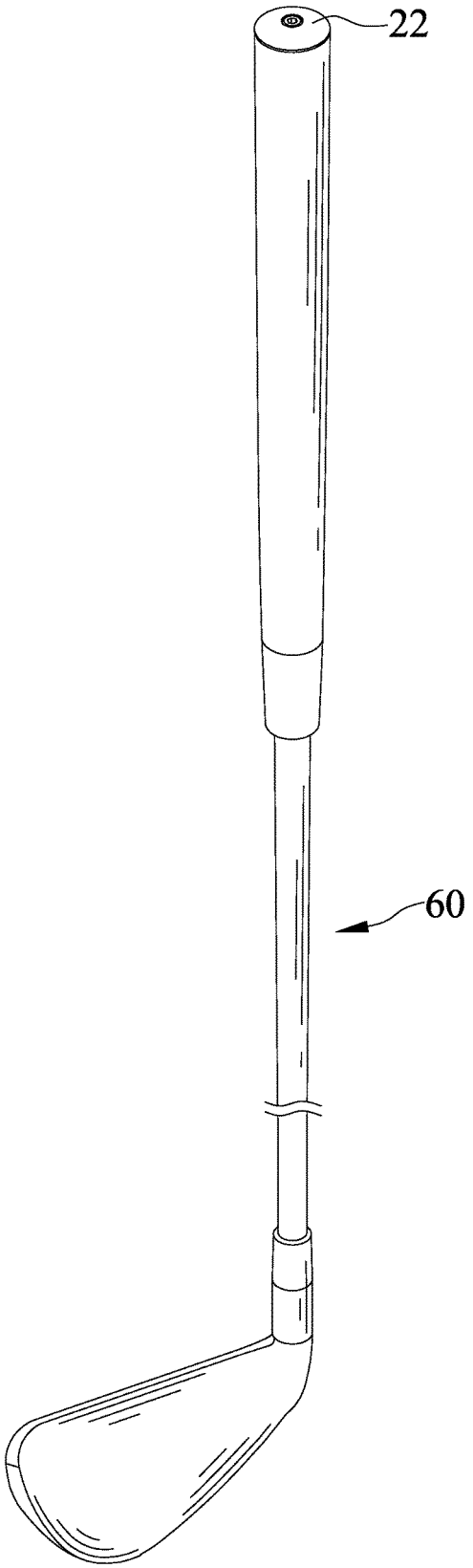
FIG. 5 is a perspective view showing an adjustable-counterbalanced handle defining a grip end of a golf club and including the weight-adjustable-counterbalance apparatus of the present invention.
Figure 6:
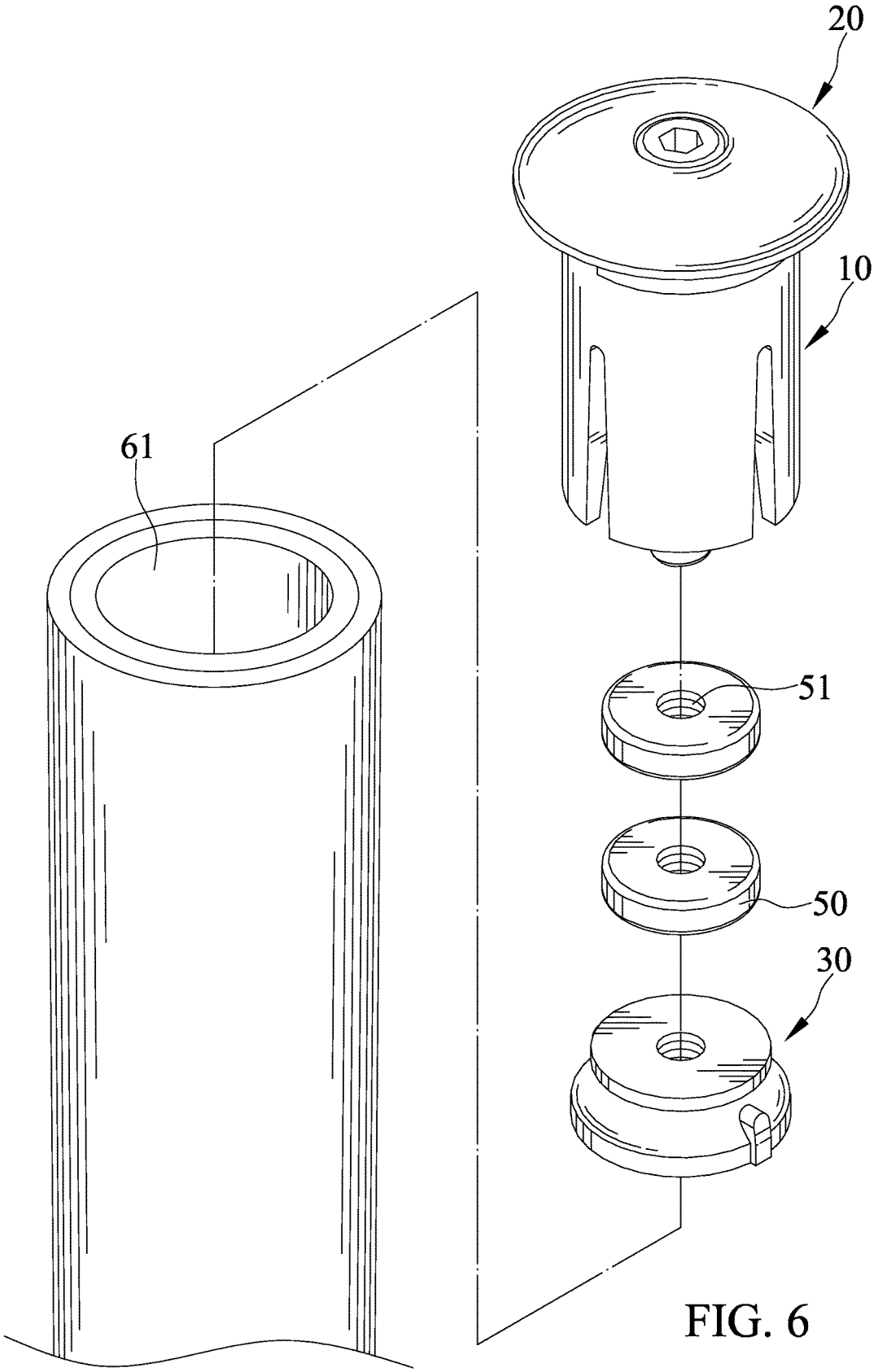
FIG. 6 is an exploded perspective view of FIG. 5 and illustrates the weight-adjustable-counterbalance apparatus of the present invention including two weighting members.
Figure 7:
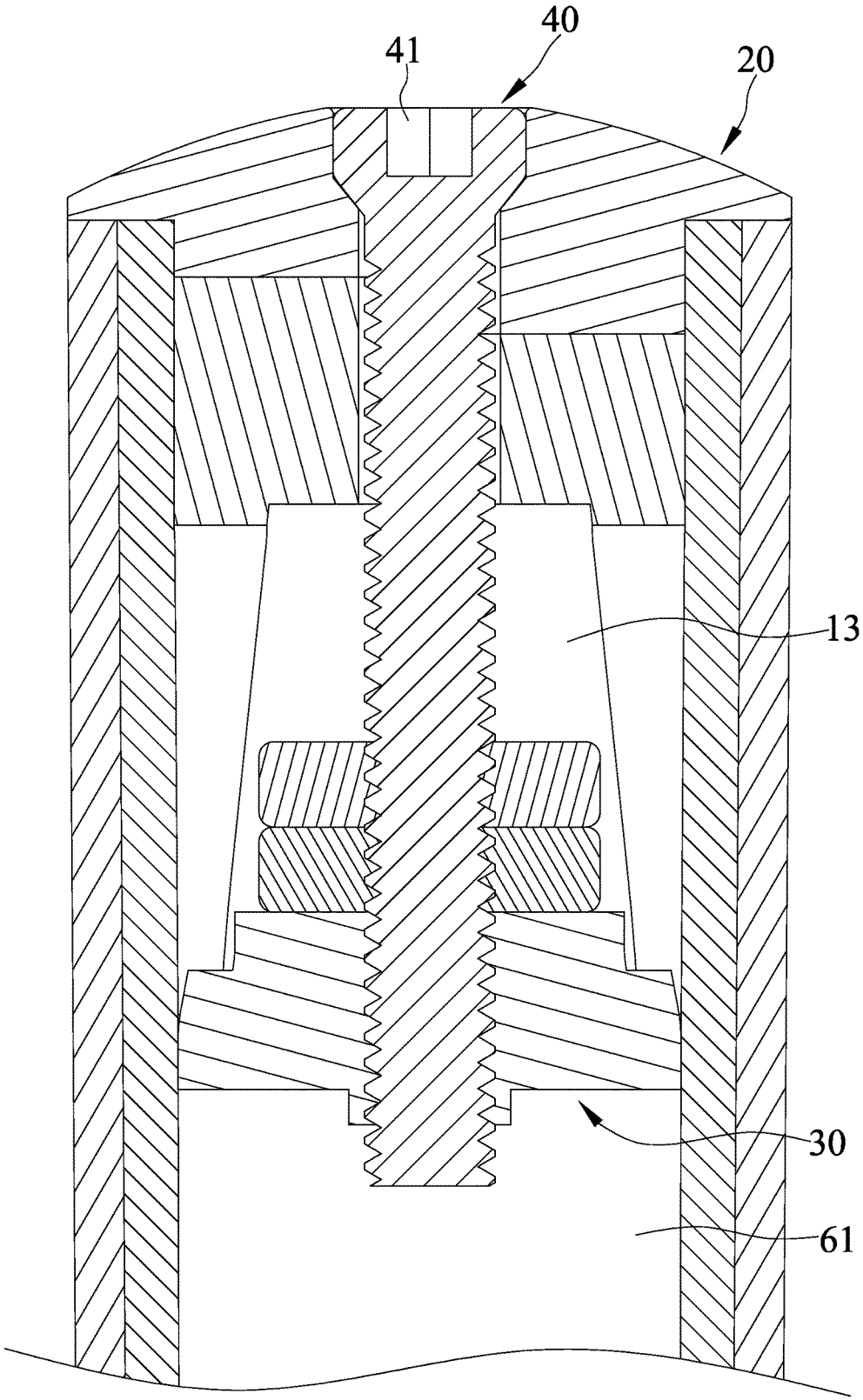
FIG. 7 is a partial, cross-sectional view of FIG. 5.

As shown in FIGS. 5 and 7, a handle defines a grip end of a golf club 60, and the weight-adjustable-counterbalance apparatus is added to the handle and disposed in a hollow 61 of the handle. Furthermore, the hollow 61 of the golf club 60 accommodates and conceals the container 10, the pedestal 21 of the first restrainer 20, and the second restrainer 30. The pedestal 21 and the second restrainer 30 are not too big to fit in the hollow 61 of the handle of the golf club 60. The flange 22 closes an opening of the hollow 61.

Figure 8:
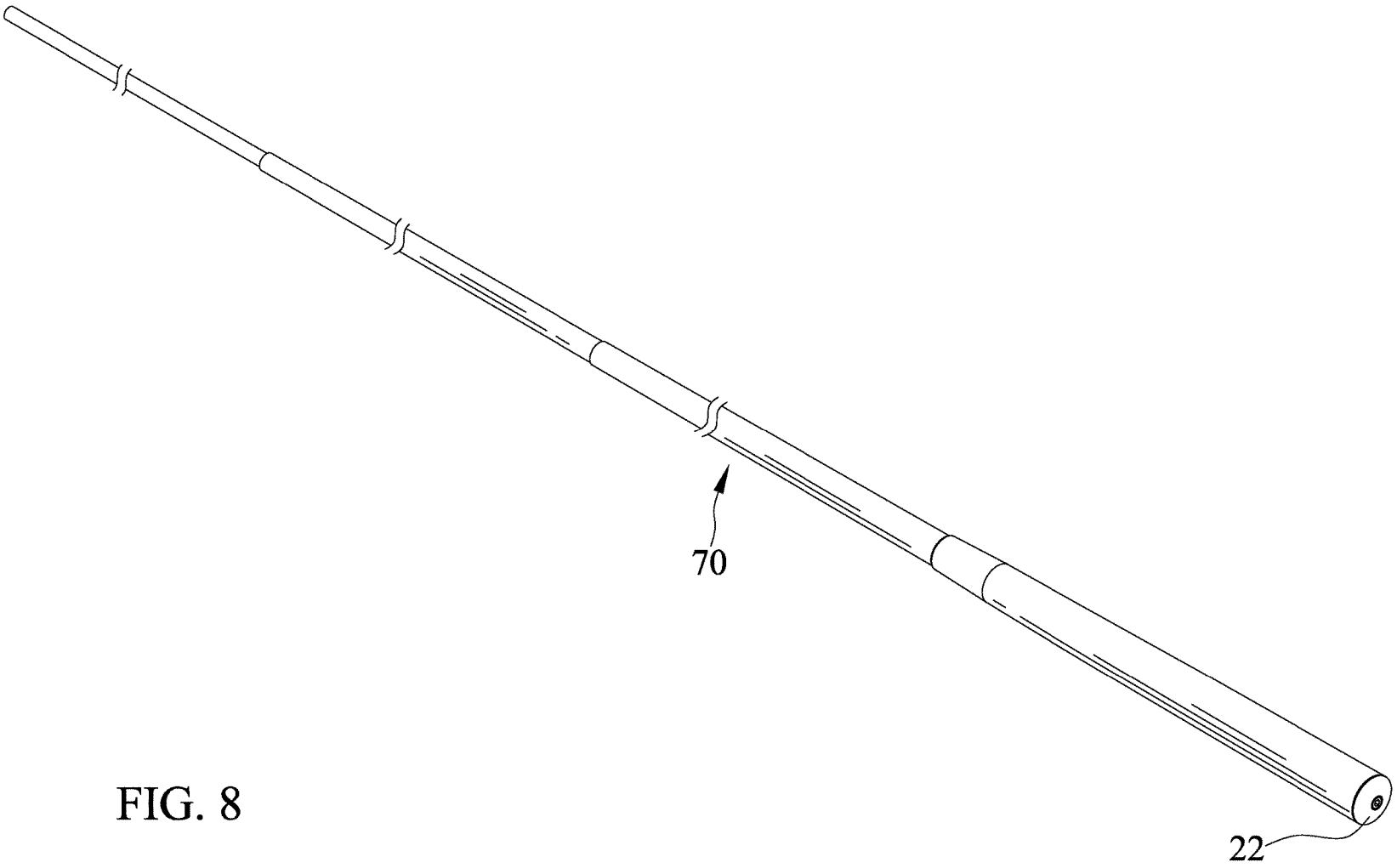
FIG. 8 is a perspective view showing an adjustable-counterbalanced handle defining a grip end of a fishing rod and including the weight-adjustable-counterbalance apparatus of the present invention.
Figure 9:
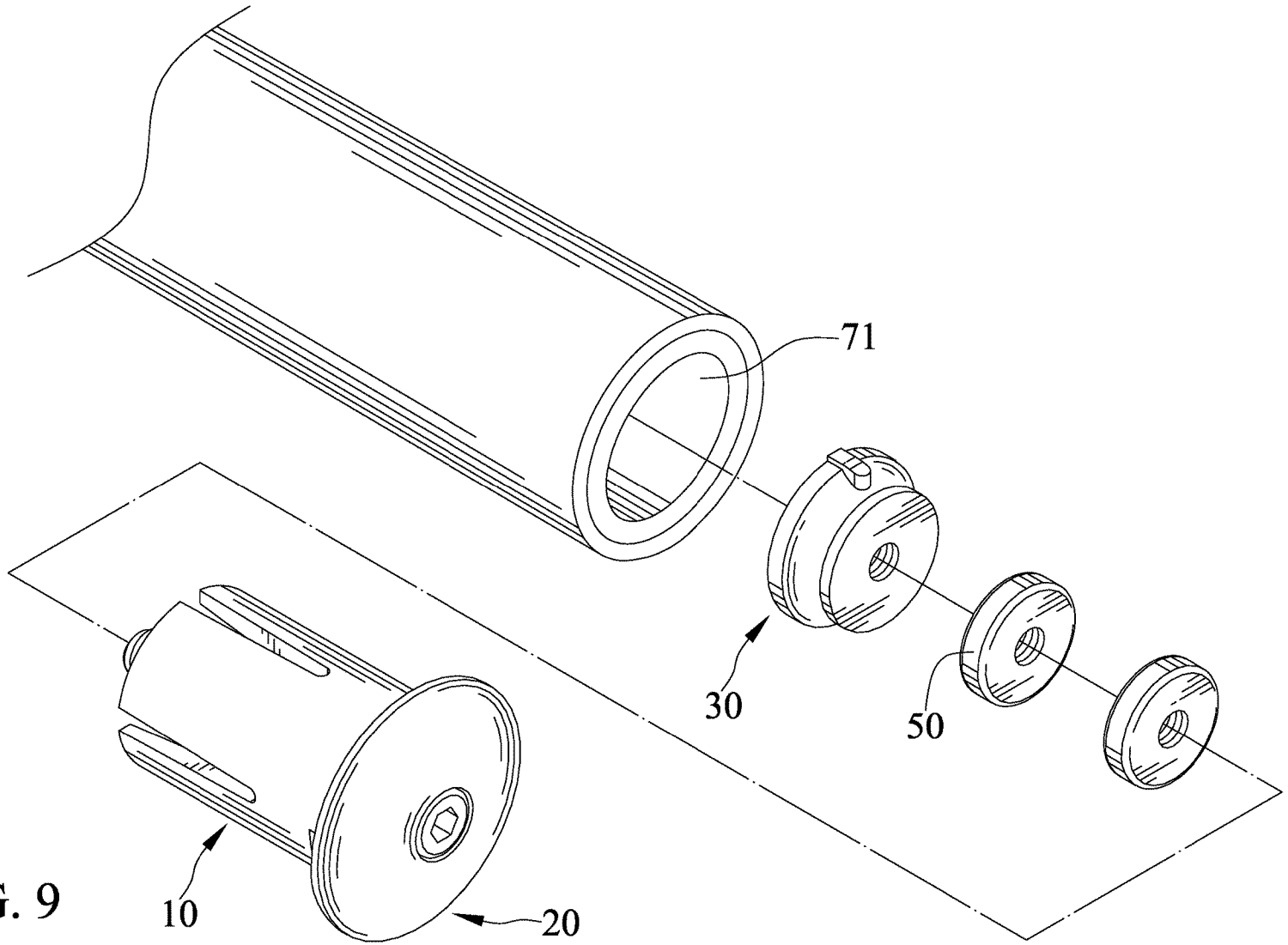
FIG. 9 is an exploded perspective view of FIG. 8 and illustrates the weight-adjustable-counterbalance apparatus of the present invention including two weighting members.

As shown in FIG. 8, a handle defines a grip end of a fishing rod 70, and the weight-adjustable-counterbalance apparatus is added to the handle and disposed in a hollow 71 of the handle. Furthermore, the hollow 71 of the fishing rod 70 accommodates and conceals the container 10, the pedestal 21 of the first restrainer 20, and the second restrainer 30. The pedestal 21 and the second restrainer 30 are not too big to fit in the hollow 71 of the handle of the fishing rod 70. The flange 22 closes an opening of the hollow 71.

Figure 10:
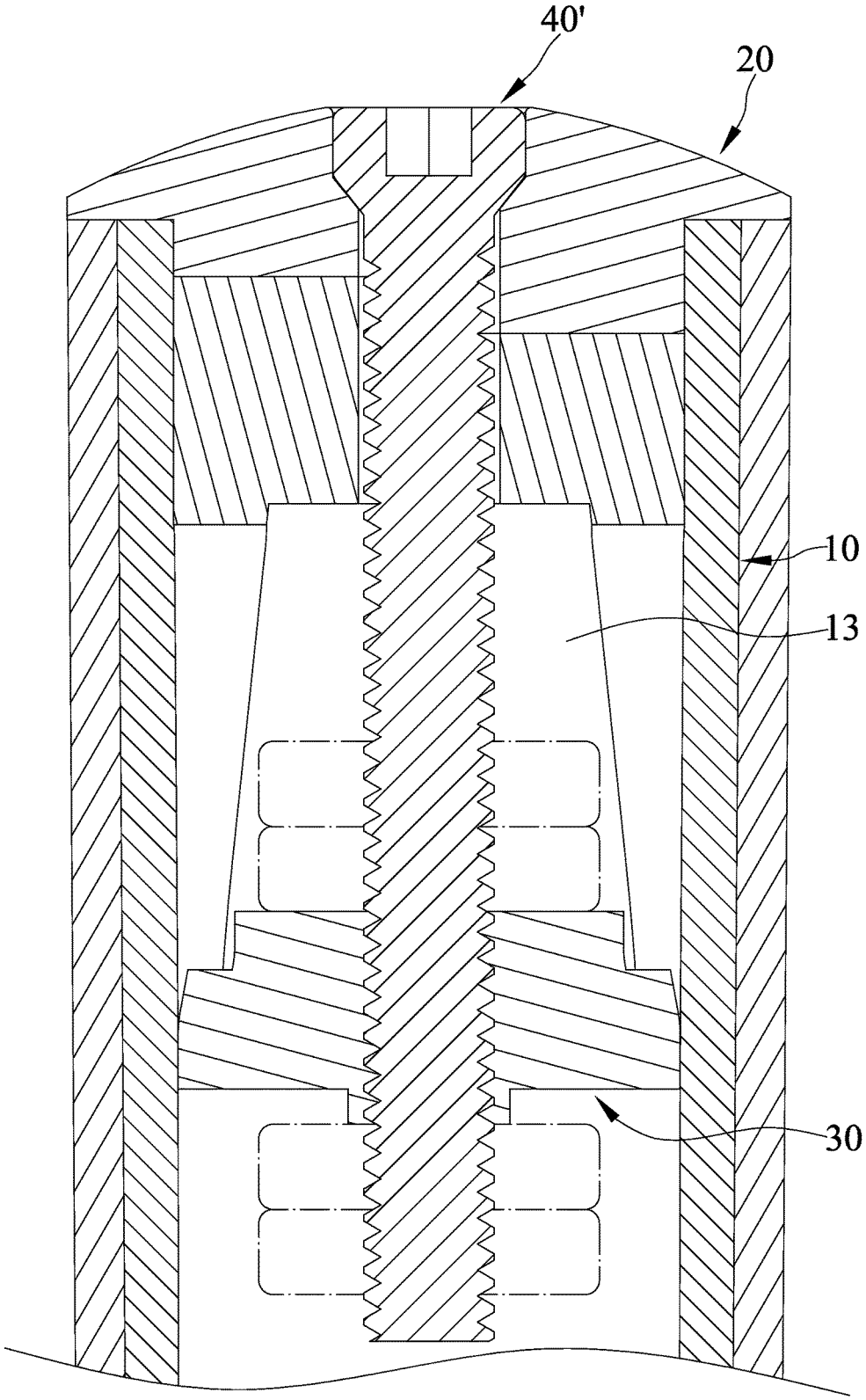
FIG. 10 is a perspective view of a weight-adjustable-counterbalance apparatus of an adjustable-counterbalanced handle in accordance with another embodiment of the present invention.

Furthermore, FIG. 10 is a perspective view of a weight-adjustable-counterbalance apparatus of an adjustable-counterbalanced handle in accordance with another embodiment of the present invention. This embodiment is similar to the said embodiment except that a fastener 40' which has a longer longitudinal length than that of the fastener 40, and it can be seen that the at least one or more weighting member 50 includes two weighting members 50, but not limited thereto, disposed inside the compartment 13 and two weighting members, but not limited thereto, disposed outside the compartment 13.

In view of the forgoing, this weighting technique changes the golf club's moment of inertia, so that it swings and feels more stable throughout the stroke. Likewise, this weighting technique changes the fishing rod's moment of inertia. The weight-adjustable-counterbalance apparatus has a counterbalance effect on a handle engaged therewith, and the effect is changed by adjusting the amount of weighting member 50 on the apparatus.

The foregoing is merely illustrative of the principles of this invention and various modifications can be made by those skilled in the art without departing from the scope and spirit of the invention.

What is claimed is:

1. A shell of a weight-adjustable-counterbalance apparatus comprising:

a container (10) having an annular lateral wall (11) and an end wall at a first end of the lateral wall (11), and defining an opening enclosed by a second end of lateral wall (11) and a compartment (13) enclosed by the lateral and end walls (11, 12);

a first restrainer (20) releasably fitting on the end wall of the container (10) and in a manner being prevented from rotating relative to the container (10), and having a pedestal (21) at one end fitting on the end wall of the container (10) and a flange (22) at another end with a diametrical size larger than a diametrical size of the pedestal;

a second restrainer (30) releasably fitting on the second end of the lateral wall (11) of and in a manner being prevented from rotating relative to the container (10); and a fastener (40, 40');

wherein the first retainer (20), the container (10), and the second retainer (30) are releasably secured together by the fastener (40, 40'); and wherein the fastener (40, 40') has a first end retained on the flange (22) of the first restrainer (20), a body inserting into a hole (23) through the flange (22) and a hole (14) through the end wall (12) as well as the compartment (13), and a second end extending outside the opening and engaging with the second restrainer (30).

2. The shell of the weight-adjustable-counterbalance apparatus as claimed in claim 1, wherein the diametrical size of the pedestal (21) is not greater than a diametrical size of the lateral wall (11), and wherein the second restrainer (30) is of a diametrical size not greater than that of the lateral wall (11).

3. The shell of the weight-adjustable-counterbalance apparatus as claimed in claim 2, wherein the lateral wall (11) and the pedestal (21) have outer peripheries being flush, with the diametrical sizes of the lateral wall (11) and the pedestal (21) being the same.

4. The shell of the weight-adjustable-counterbalance apparatus as claimed in claim 1, wherein the container (10) has a plurality of slots (15) on the lateral wall (11), wherein the plurality of slots (15) extends radially through the lateral wall (11) and communicates with the compartment (13), and wherein the plurality of slots (15) has a closed end at a first end and an open end at a second end and defines a longitudinal length between the first and second end thereof.

5. The shell of the weight-adjustable-counterbalance apparatus as claimed in claim 4, wherein the second restrainer (30) has an outer periphery and a plurality of ribs (31) on the outer periphery, and wherein each of the plurality of slots (15) respectively receives the each of the plurality of ribs (31).

6. The shell of the weight-adjustable counterbalance apparatus as claimed in claim 1, wherein the end wall (12) and the pedestal (21) each have an outer edge defining a surface and a protuberance on the surface, wherein the protuberance is at a higher height than the surface, and wherein the outer edges of the end wall (12) and the pedestal (21) have shapes matching with one another.

7. The shell of the weight-adjustable counterbalance apparatus as claimed in claim 1, wherein the flange (22) of the first restrainer (20) defines a recess and the first end of the fastener (40, 40') is received in the recess, wherein the recess is of a size as such the first end of the fastener (40, 40') is not protruded above the flange (22), and wherein the recess communicates with the hole (23) through the pedestal (21).

8. The shell of the weight-adjustable-counterbalance apparatus as claimed in claim 1, wherein the fastener (40, 40') defines a threaded section and the second restrainer (30) defines a threaded hole (32) therethrough in thread engagement with the fastener (40, 40').

9. The shell of the weight-adjustable-counterbalance apparatus as claimed in claim 8, wherein the fastener (40, 40') includes the first end thereof defining a head with a cavity (41).

10. A weight-adjustable-counterbalance apparatus comprising:

a shell comprising:

a container (10) having an annular lateral wall (11) and an end wall at a first end of the lateral wall (11), and defining an opening enclosed by a second end of lateral wall (11) and a compartment (13) enclosed by the lateral and end walls (11, 12);

a first restrainer (20) releasably fitting on the end wall of the container (10) and in a manner being prevented from rotating relative to the container (10), and having a pedestal (21) at one end fitting on the end wall of the container (10) and a flange (22) at another end with a diametrical size larger than a diametrical size of the pedestal;

a second restrainer (30) releasably fitting on the second end of the lateral wall (11) of and in a manner being prevented from rotating relative to the container (10); and a fastener (40, 40') releasably securing the first retainer (20), the container (10), and the second retainer (30) together, and having a first end retained on the flange (22) of the first restrainer (20), a body inserting into a hole (23) through the flange (22) and a hole (14) through the end wall (12) as well as the compartment (13), and a second end extending outside the opening and engaging with the second restrainer (30);

at least one or more weighting member (50) selectively added to the shell by releasably fitting on the fastener (40, 40'), and being positioned inside and/or outside the compartment (13).

11. The weight-adjustable-counterbalance apparatus as claimed in claim 10, wherein the diametrical size of the pedestal (21) is not greater than a diametrical size of the lateral wall (11), and wherein the second restrainer (30) is of a diametrical size not greater than that of the lateral wall (11).

12. The weight-adjustable-counterbalance apparatus as claimed in claim 11, wherein the lateral wall (11) and the pedestal (21) have outer peripheries being flush with the diametrical sizes of the lateral wall (11) and the pedestal (21) being the same.

13. The weight-adjustable-counterbalance apparatus as claimed in claim 10, wherein the container (10) has a plurality of slots (15) on the lateral wall (11), wherein the plurality of slots (15) extends radially through the lateral wall (11) and communicates with the compartment (13), and wherein the plurality of slots (15) has a closed end at a first end and an open end at a second end and defines a longitudinal length between the first and second end thereof.

14. The weight-adjustable-counterbalance apparatus as claimed in claim 13, wherein the second restrainer (30) has an outer periphery and a plurality of ribs (31) on the outer periphery, and wherein each of the plurality of slots (15) respectively receives the each of the plurality of ribs (31).

15. The weight-adjustable counterbalance apparatus as claimed in claim 10, wherein the end wall (12) and the pedestal (21) each have an outer edge defining a surface and a protuberance on the surface, wherein the protuberance is at a higher height than the surface, and wherein the outer edges of the end wall (12) and the pedestal (21) have shapes matching with one another.

16. The weight-adjustable counterbalance apparatus as claimed in claim 10, wherein the flange (22) of the first restrainer (20) defines a recess and the first end of the fastener (40, 40') is received in the recess, wherein the recess is of a size as such the first end of the fastener (40, 40') is not protruded above the flange (22), and wherein the recess communicates with the hole (23) through the pedestal (21).

17. The weight-adjustable-counterbalance apparatus as claimed in claim 10, wherein the fastener (40, 40') defines a threaded section and the at least one or more weighting member (50) defines a threaded hole (51) therethrough in thread engagement with the fastener (40, 40').

18. The weight-adjustable-counterbalance apparatus as claimed in claim 17, wherein the second restrainer (30) defines a threaded hole (32) therethrough in thread engagement with the fastener (40, 40').

19. The weight-adjustable-counterbalance apparatus as claimed in claim 18, wherein the fastener (40, 40') includes the first end thereof defining a head with a cavity (41).

* * * * *